US010421303B2

(12) United States Patent
Stamp et al.

(10) Patent No.: US 10,421,303 B2
(45) Date of Patent: Sep. 24, 2019

(54) AIR FILTER FOR INK JET PRINTER

(71) Applicant: VIDEOJET TECHNOLOGIES INC., Wood Dale, IL (US)

(72) Inventors: Michael Stamp, Leicestershire (GB); Calvin Townsend, Huntingdon Cambridgeshire (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 15/736,674

(22) PCT Filed: Jun. 14, 2016

(86) PCT No.: PCT/US2016/037325
§ 371 (c)(1),
(2) Date: Dec. 14, 2017

(87) PCT Pub. No.: WO2016/205173
PCT Pub. Date: Dec. 22, 2016

(65) Prior Publication Data

US 2018/0354283 A1 Dec. 13, 2018

(30) Foreign Application Priority Data

Jun. 15, 2015 (GB) ..... 1510456.5

(51) Int. Cl.
*B41J 2/18* (2006.01)
*B41J 2/17* (2006.01)
(Continued)

(52) U.S. Cl.
CPC ..... *B41J 29/377* (2013.01); *B41J 2/1714* (2013.01); *B41J 2/1752* (2013.01);
(Continued)

(58) Field of Classification Search
CPC ... B41J 2/14; B41J 2/1714; B41J 2/175; B41J 2/1752; B41J 2/17523; B41J 2/17546;
(Continued)

(56) References Cited

U.S. PATENT DOCUMENTS 4,600,326 A 7/1986 Fudatsuji et al.
5,296,873 A * 3/1994 Russell ..... B41J 2/1714 101/424.1
(Continued)

FOREIGN PATENT DOCUMENTS

EP 0526884 A2 2/1993
EP 0571785 A2 12/1993
(Continued)

OTHER PUBLICATIONS

PCT/US2016/037325 International Search Report and Written Opinion, dated Feb. 3, 2017, 25 pages.

*Primary Examiner* — Anh T Vo
(74) *Attorney, Agent, or Firm* — Beusse, Wolter, Sanks & Maire PLLC; Robert L. Wolter

(57) ABSTRACT

Apparatus for use in continuous inkjet printing, comprising: a cabinet, an ink system located in the cabinet, the ink system comprising, an ink pump, an ink system air inlet, and an ink system air outlet, and an air circulation device arranged to cause air to flow within the cabinet. The air circulation device is arranged to cause air to flow along a predetermined air flow path through the ink system air inlet, past the ink pump, and through the ink system air outlet.

20 Claims, 8 Drawing Sheets

(51) Int. Cl.
*B41J 29/02* (2006.01)
*B41J 29/377* (2006.01)
*B41J 2/175* (2006.01)

(52) U.S. Cl.
CPC ..... *B41J 2/17523* (2013.01); *B41J 2/17546* (2013.01); *B41J 2/17556* (2013.01); *B41J 2/17563* (2013.01); *B41J 2/17566* (2013.01); *B41J 2/17596* (2013.01); *B41J 2/18* (2013.01); *B41J 29/02* (2013.01); *B41J 2202/02* (2013.01)

(58) Field of Classification Search
CPC ..... B41J 2/17556; B41J 2/17563; B41J 2/17566; B41J 2/17596; B41J 2/18; B41J 29/02; B41J 29/377; B41J 2202/02
See application file for complete search history.

(56) References Cited

U.S. PATENT DOCUMENTS

| | | | | |
|---|---|---|---|---|
| 6,347,864 | B1 | 2/2002 | Silverbrook et al. | |
| 6,439,712 | B1 * | 8/2002 | Mizutani | B41J 2/01 219/216 |
| 6,714,229 | B2 * | 3/2004 | Miyazaki | B41J 29/13 347/223 |
| 8,061,833 | B2 * | 11/2011 | Onozawa | B41J 11/002 347/102 |
| 8,845,066 | B2 * | 9/2014 | Domae | B41J 29/377 347/102 |
| 2003/0214566 | A1 | 11/2003 | Miyazaki et al. | |
| 2006/0116065 | A1 | 6/2006 | Ishii | |
| 2006/0201870 | A1 | 9/2006 | Seto et al. | |
| 2010/0097417 | A1 * | 4/2010 | Hill | B41J 2/1707 347/9 |
| 2011/0050824 | A1 * | 3/2011 | Toya | B41J 11/002 347/102 |
| 2011/0200494 | A1 | 8/2011 | Tanaka | |
| 2014/0146107 | A1 | 5/2014 | Lo et al. | |

FOREIGN PATENT DOCUMENTS

| | | | |
|---|---|---|---|
| FR | 2776568 | A1 | 10/1999 |
| JP | 2002321426 | A | 11/2002 |
| JP | 2010280113 | A | 12/2010 |
| JP | 2014180784 | A | 9/2014 |
| WO | 1994019197 | A1 | 9/1994 |
| WO | 2009051149 | A1 | 4/2009 |
| WO | 20100026905 | A1 | 3/2010 |
| WO | 2014010389 | A1 | 1/2014 |

* cited by examiner

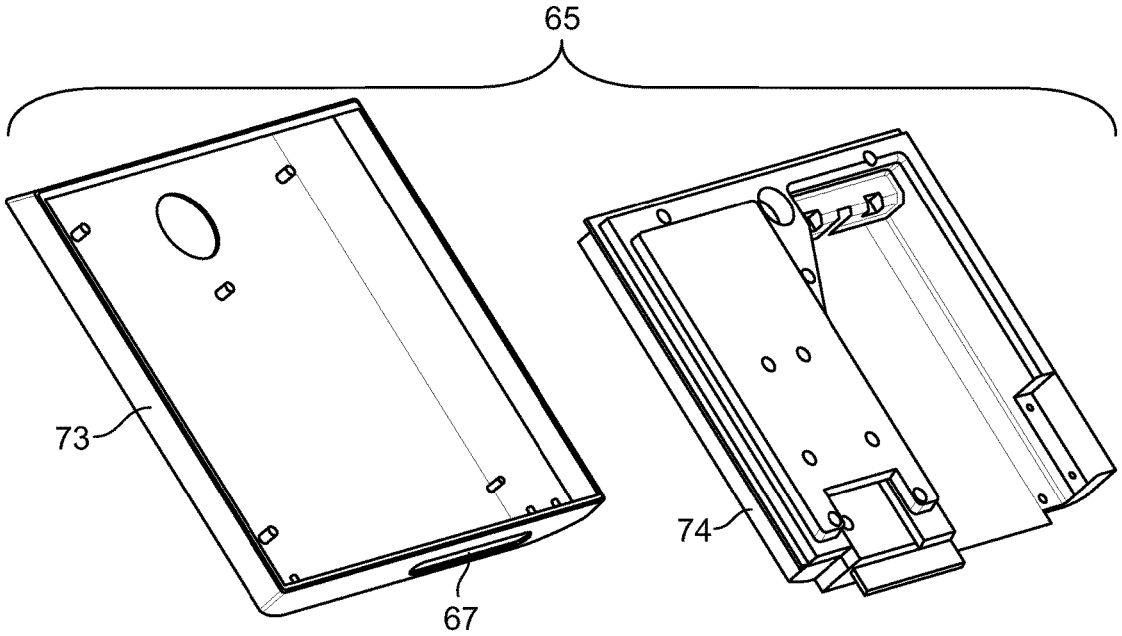
FIG. 6A
FIG. 6B
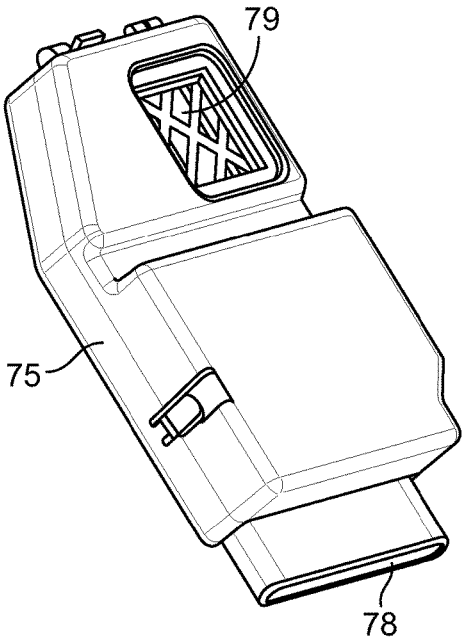
FIG. 6C

AIR FILTER FOR INK JET PRINTER

BACKGROUND

The present invention relates to ink jet printing and more particularly to an apparatus and filter unit for use in ink jet printing, such as, for example continuous ink jet printing.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix including a regular array of potential drop positions. Each matrix includes a plurality of columns (strokes), each being defined by a line including a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. To compensate for this, "make-up" solvent is added to the ink as required from a replaceable ink cartridge so as to maintain the ink viscosity within desired limits. This solvent may also be used for flushing components of the print head, such as the nozzle and the gutter, in a cleaning cycle.

The use of solvents within the printing system may result in solvent vapor leaking within enclosed spaces which could result in elevated solvent vapor levels. It is known to provide purging air circulation within printing systems to carry away any solvent vapor before it can reach harmful or dangerous levels. Additionally, various components such as pumps and motors generate heat the can increase the temperature of the ink within the system. As the ink temperature increases, the tendency for solvents to volatilize also increases. Further, increased temperature also changes the viscosity of the ink, which must be controlled to within desired ranges to achieve optimal printing performance.

It is an object of the present invention, amongst others, to provide an improved or an alternative ink jet printer. Further, the present invention provides an ink jet printer with an improved air circulation and cooling system.

BRIEF SUMMARY

According to a first aspect of the present invention there is provided an apparatus for use in continuous inkjet printing, including: a cabinet, an ink system located in the cabinet, the ink system including, an ink pump, an ink system air inlet, and an ink system air outlet, and an air circulation device arranged to cause air to flow within the cabinet. The air circulation device is arranged to cause air to flow along a predetermined air flow path through the ink system air inlet, past the ink pump, and through the ink system air outlet.

The provision of an air circulation device allows an air flow to be used both for purging solvent vapor from within the cabinet, and also to provide cooling for the ink pump given that the predetermined flow path goes past the ink pump. The cooling of the ink pump also allows heat from the ink itself to be dissipated. Thus heat from the ink is dissipated via the ink pump without the need for a dedicated ink cooling apparatus.

Air flow along the predetermined air flow path may cool the ink pump and thereby cool ink passing through the ink pump.

The apparatus may further include an air filter unit being arranged to receive an air filter, the air filter unit including a filter unit air inlet, and a filter unit air outlet; wherein, in use, the filter unit air outlet is arranged adjacent the ink system air inlet; and the air circulation device is arranged to cause air to flow through the filter unit air inlet, the air filter, the filter unit air outlet, and along the predetermined path.

The provision of an air filter unit to direct air flow through the apparatus according to a predetermined air flow path allows the air flow to be controlled for both for purging and cooling purposes. Further, the provision of an air filter unit allows simple replacement or cleaning of an air filter to be carried out at convenient intervals without the need to specialist tools or expertise.

The apparatus may be described as an ink delivery system. The ink system may be described as an ink storage system.

The air filter unit may be removable from the apparatus.

The filter unit air inlet may be arranged to mate with an air inlet of the housing.

The filter unit air outlet may be arranged to mate with the ink system air inlet.

A seal may be formed between the filter unit air outlet and the ink system air inlet.

The filter unit may include a seal member arranged to engage with an outer surface of the ink system air inlet to form the seal.

The air circulation device may be provided in the air flow path intermediate the ink system air inlet and the ink system air outlet.

The air circulation device may be provided in the air flow path intermediate the ink system air inlet and the ink pump.

The ink pump may be proximal to the ink system air inlet.

The ink system may further include an ink pump heat sink in thermal communication with the ink pump, the air circulation device being arranged to cause air to flow past the ink pump heat sink.

By thermal communication it is meant that thermal energy is able to flow between the ink pump and the ink pump heat sink, i.e. that there is a path for thermal conduction between the ink pump and the ink pump heat sink.

The ink system may further include a condenser for condensing solvent vapor, and a condenser heat sink in thermal communication with the condenser, the air circulation device being arranged to cause air to flow past the condenser heat sink.

The air circulation device may be provided adjacent to the ink pump.

The air circulation device may, for example, be a component of the ink system.

The air circulation device may include a fan.

The cabinet may include a base, and an air outlet may be provided at the base of the cabinet, the air circulation device causing air to flow along the predetermined path and through the air outlet.

The cabinet may include a door, the air filter unit being received within the door.

The location of the air filter unit within the door provides a convenient and accessible location of the air filter unit, which also allows both the interior of the cabinet to be accessed (without being impeded by the air filter unit) and the air filter unit itself to be accessed for routine and preventative maintenance.

The air filter unit may be removably received within the door.

The door may include an air inlet, the filter unit air inlet being arranged to mate with the air inlet when the air filter unit is received within the door.

The mating of the air filter unit with the air inlet within the door provides a simple and convenient air flow path into the cabinet.

The door may be moveable between an open position and a closed position and when in the closed position the filter unit air outlet may be arranged adjacent the ink system air inlet.

The air filter unit may be removable from the door when the door is in the open position.

When the door is in the closed position a seal may be formed between the filter unit air outlet and the ink system air inlet.

The filter unit air inlet may be provided at a lower end of the door when the door is in the closed position.

The ink system may further include an ink tank for storing ink for use during printing operations.

The air filter unit may include an inlet labyrinth arranged to obstruct a direct path between the filter unit air inlet and the air filter. The inlet labyrinth may include an inlet baffle.

The air filter unit may include a body, the filter unit air inlet and filter unit air outlet being defined by said body.

The body may further define a recess for receiving the air filter.

The filter unit air inlet may be defined in a first side of the body and the filter unit air outlet may be defined in a second side of the body, the first and second sides being generally perpendicular.

The body may be formed of two components which are hinged together.

The air filter maybe removable from the recess by opening the two components.

According to a second aspect of the invention there is provided a filter unit for a continuous inkjet printer including: a body, a filter unit air inlet defined by the body and arranged to mate with an air inlet of an ink jet printer cabinet, a recess for receiving an air filter defined by the body, a filter unit air outlet defined by the body and arranged to mate with an air inlet of an ink system located in an ink jet printer cabinet.

The air inlet may be defined in a first side of the body and the outlet in a second side of the body, the first and second sides being generally perpendicular.

The body may be formed of two components which are hinged together.

The air filter may be removable from the recess by opening the two components.

The air filter unit may include an inlet labyrinth arranged to obstruct a direct path between the filter unit air inlet and the air filter. The inlet labyrinth may include an inlet baffle.

The filter unit air outlet may be configured to form a seal with an air inlet of an ink system located in an ink jet printer cabinet.

The filter unit may include a seal member configured to engage with an outer surface of an air inlet of an ink system to form the seal.

According to a third aspect of the invention there is provided an apparatus for use in continuous inkjet printing, including: a cabinet; an ink system located in the cabinet, the ink system including, an ink pump; and an air circulation device arranged adjacent to the ink pump and arranged to cause air to flow past the ink pump. Air flow along the predetermined air flow path cools the ink pump and thereby cools ink passing through the ink pump.

The air circulation device may be arranged to cause air to flow past the ink pump along a predetermined air flow path.

The apparatus may include an air filter unit arranged to receive an air filter.

The air circulation device may be arranged to cause air to flow through the air filter and past the ink pump along the predetermined air flow path.

According to a fourth aspect of the invention there is provided a method for cooling ink in a continuous ink jet printer, the method including: pumping ink using an ink pump; causing air flow over the ink pump using an air circulation device, wherein the air flow effects cooling of the ink.

It will be appreciated that features described in the context of one aspect of the invention may be used in combination with other aspects of the invention. In particular, features described in the context of the first and second aspects of the invention may be used in combination with the third and fourth aspects of the invention.

Embodiments of the present invention will now be described, by way of example, with reference to the accompanying drawings, in which:

BRIEF DESCRIPTION OF THE DRAWINGS

FIGS. 6A-6C are perspective illustrations of parts of the continuous ink jet printer of FIG. 1;

DETAILED DESCRIPTION

Figure 1:
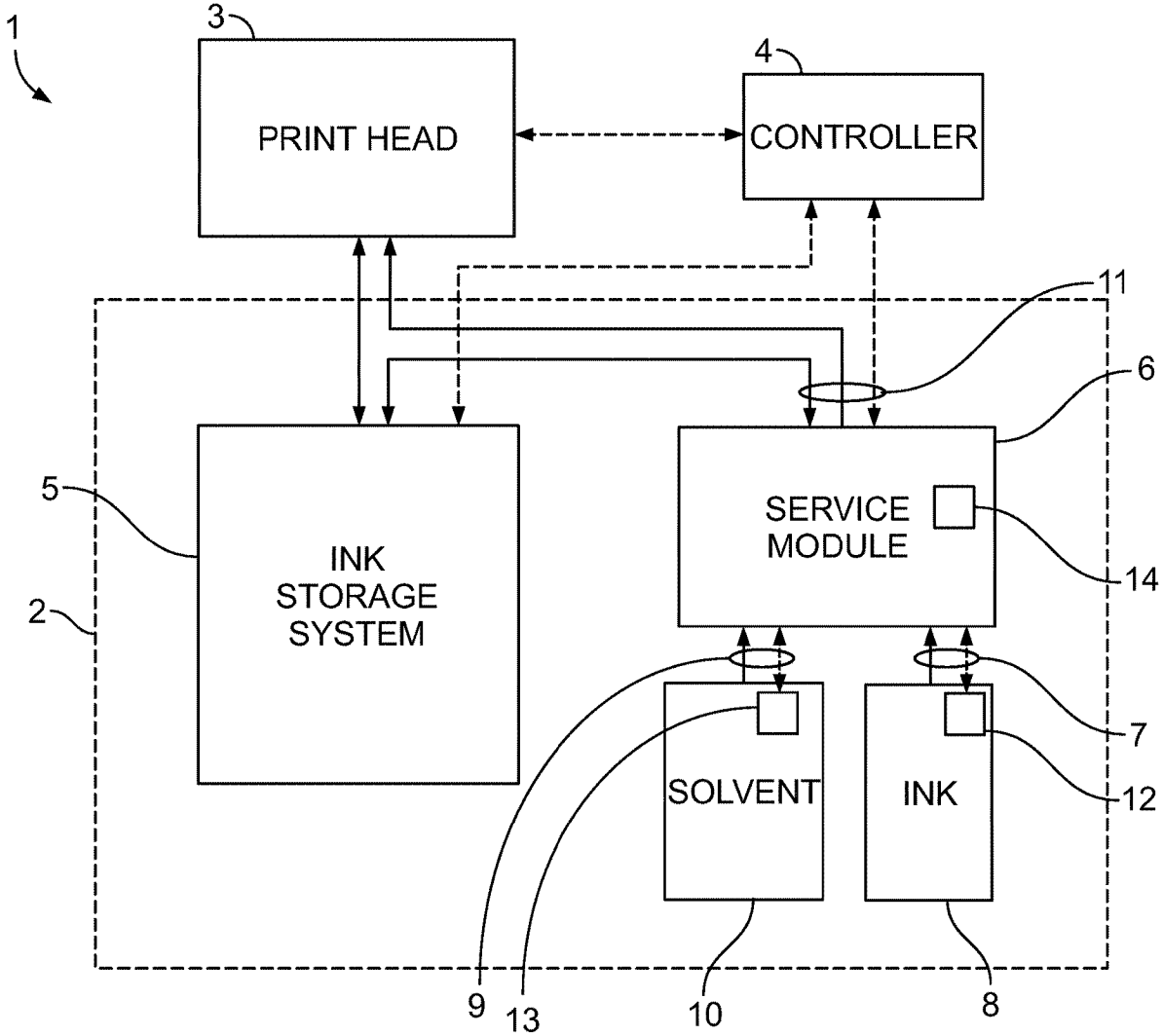
FIG. 1 is a schematic illustration of a continuous ink jet printer in accordance with an embodiment of the invention.

FIG. 1 schematically illustrates an inkjet printer 1. Inkjet printer 1 includes an ink supply system 2, a print head 3 and a controller 4. The ink supply system 2 includes an ink storage system 5 and a service module 6 according to an embodiment of the present invention. In FIG. 1, fluid flow through the inkjet printer is illustrated schematically by solid arrows and control signals are illustrated schematically by dashed arrows. The service module 6 is configured for releasable engagement with inkjet printer 1 so that the module can be easily removed from the inkjet printer 1 for servicing or replacement. The service module 6 is therefore a removable module for an inkjet printer.

The service module 6 includes two cartridge connections for releasable engagement with a fluid cartridge. In particular, the service module 6 includes an ink cartridge connection 7 for releasable engagement with an ink cartridge 8 and a solvent cartridge connection 9 for releasable engagement with a solvent cartridge 10. The service module 6 further includes a printer connection 11 for releasable engagement with an inkjet printer. In use, the service module 6 forms part of inkjet printer 1 and it will be appreciated that in this context in the expression "for releasable engagement with an inkjet printer" the term "inkjet printer" is intended to mean those parts of the inkjet printer excluding the service module 6.

The printer connection 11 includes a plurality of fluid ports, each fluid port arranged to connect to a fluid pathway within the inkjet printer 1 to allow fluid to flow between the service module 6 and other parts of the inkjet printer 1, such as the ink storage system 5 and the print head 3. The printer connection 11 further includes an electrical connector arranged to engage with a corresponding connector on the inkjet printer 1.

Each of the ink and solvent cartridge connections 7, 9 includes a fluid connector for engaging an outlet of respective ink and solvent cartridges 8, 10 so as to allow fluid to flow from the cartridges 8, 10 into the service module 6. From the service module 6, ink and solvent can flow to the ink storage system 5 via the printer connection 11. In operation, ink from the ink cartridge 8 and solvent from the solvent cartridge 10 can be mixed within the ink storage system 5 so as to generate printing ink of a desired viscosity which is suitable for use in printing. This ink is supplied to the print head 3 and unused ink is returned from the print head 3 to the ink storage system 5. The service module 6 is also operable to provide a flow of solvent to the print head 3 via printer connection 11 for cleaning purposes.

The ink jet printer 1 is controlled by controller 4. Controller 4 receives signals from various sensors within the inkjet printer 1 and is operable to provide appropriate control signals to the ink supply system 2 and the print head 3 to control the flow of ink and solvent through the inkjet printer 1. The controller 4 may be any suitable device known in the art, and typically includes at least a processor and memory.

The ink cartridge 8 may be provided with an electronic data storage device 12 storing data relating to contained ink (e.g. type and quantity of ink). Similarly, the solvent cartridge 10 may be provided with an electronic data storage device 13 storing data relating to contained solvent (e.g. type and quantity of solvent). The service module 6 includes an electronic data storage device 14. Electronic data storage device 14 may store identification data (e.g. an identification code). Electronic data storage device 14 may also store other types of data, such as identification relating to the type of ink and/or solvent that the service module 6 can be used with (or has previously been used with), a model number of the service module 6 or inkjet printer 1, a serial number, a manufacture date, an expiration date, a date first used in service, number of hours the service module 6 has been used in the inkjet printer 1, service life, and the like. Information stored on any one of the electronic data storage devices 12, 13, 14 may be stored in encrypted form. This may prevent any tampering of the data. The electronic data storage device 14 may include security data so that only suitable or recognized service modules 6 can be used with the inkjet printer 1. The electronic data storage device 14 may also include a writable data portion. The inkjet printer 1 may write to the electronic data storage device 14 to indicate that the service module 6 has reached the end of its service life, so that the service module can no longer be used in the inkjet printer 1 or any other printer.

The controller 4 is arranged to communicate with the electronic data storage devices 12, 13. This communication with the electronic data storage devices 12, 13 of cartridges 8, 10 is via the service module 6. Each of the ink and solvent cartridge connections 7, 9 includes an electrical contact arranged to contact a corresponding contact on the engaged ink or solvent cartridge 8, 10. The corresponding contact on the cartridges 8, 10 allows information to be read from and/or written to data storage devices 12, 13 respectively via the printer connection 11 of the service module 6.

For example, when the ink supply system 2 is first used, data from the electronic data storage device 12 and/or the electronic data storage device 13 is read to ascertain a type of ink and/or solvent being used. Subsequently, when a new ink cartridge or solvent cartridge is used within the printer 1, a check may be made by the controller 4 of data stored on respective electronic data storage devices 12, 13 of the ink cartridge 8 and the solvent cartridge 10 to ensure compatibility. In this way, when the ink supply system 2 is used with a particular type of ink, the controller 4 ensures that the printer 1 is operable (i.e. ensures that ink is allowed to flow from the ink cartridge 8 and/or that solvent is allowed to flow from the solvent cartridge 10) only if data associated with the ink cartridge 8 and/or solvent cartridge 10 as stored on the electronic data storage devices 12, 13 indicates compatibility.

Figure 2:
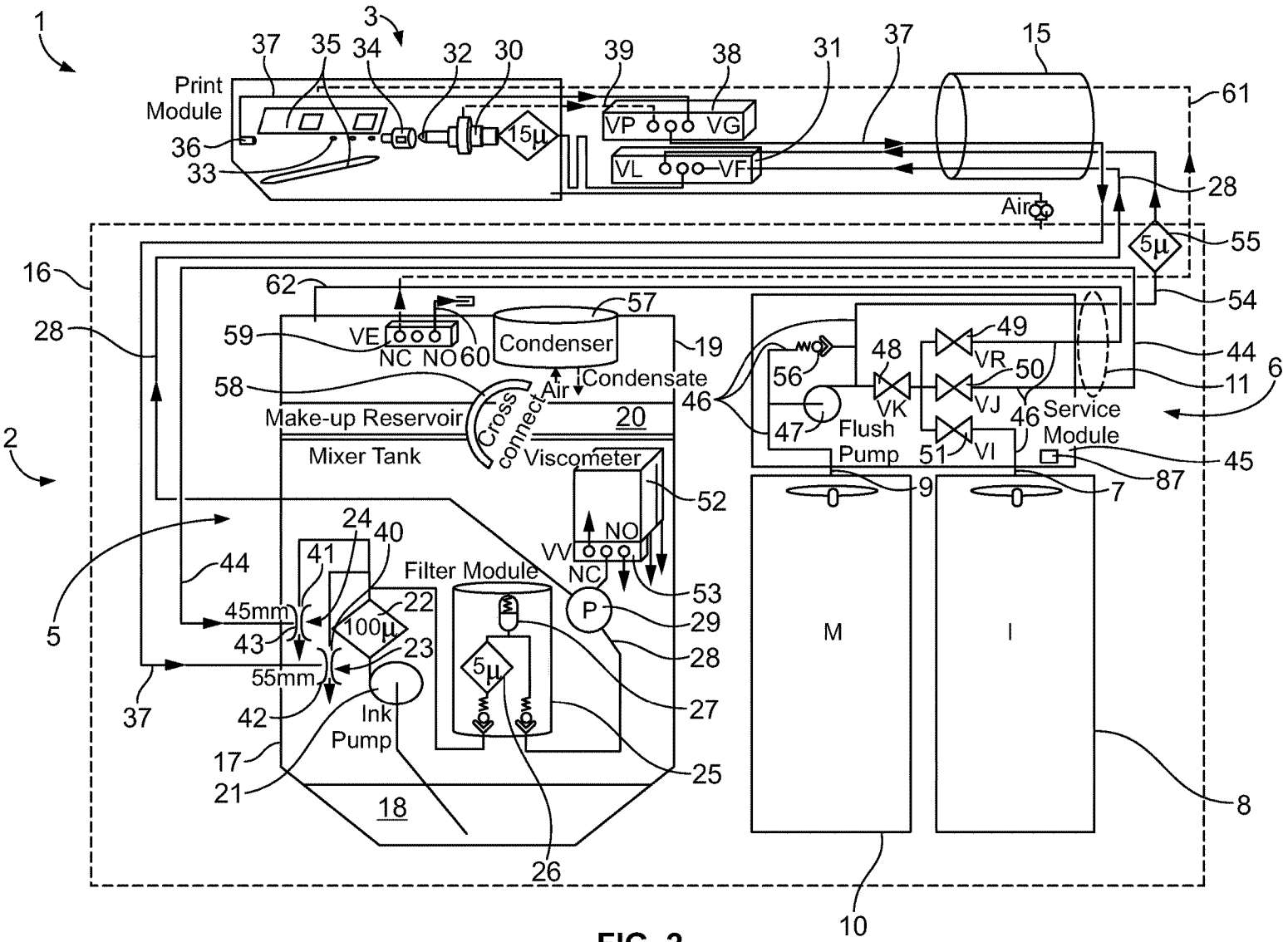
FIG. 2 is a schematic representation of the continuous ink jet printer of FIG. 1.
Figure 3:
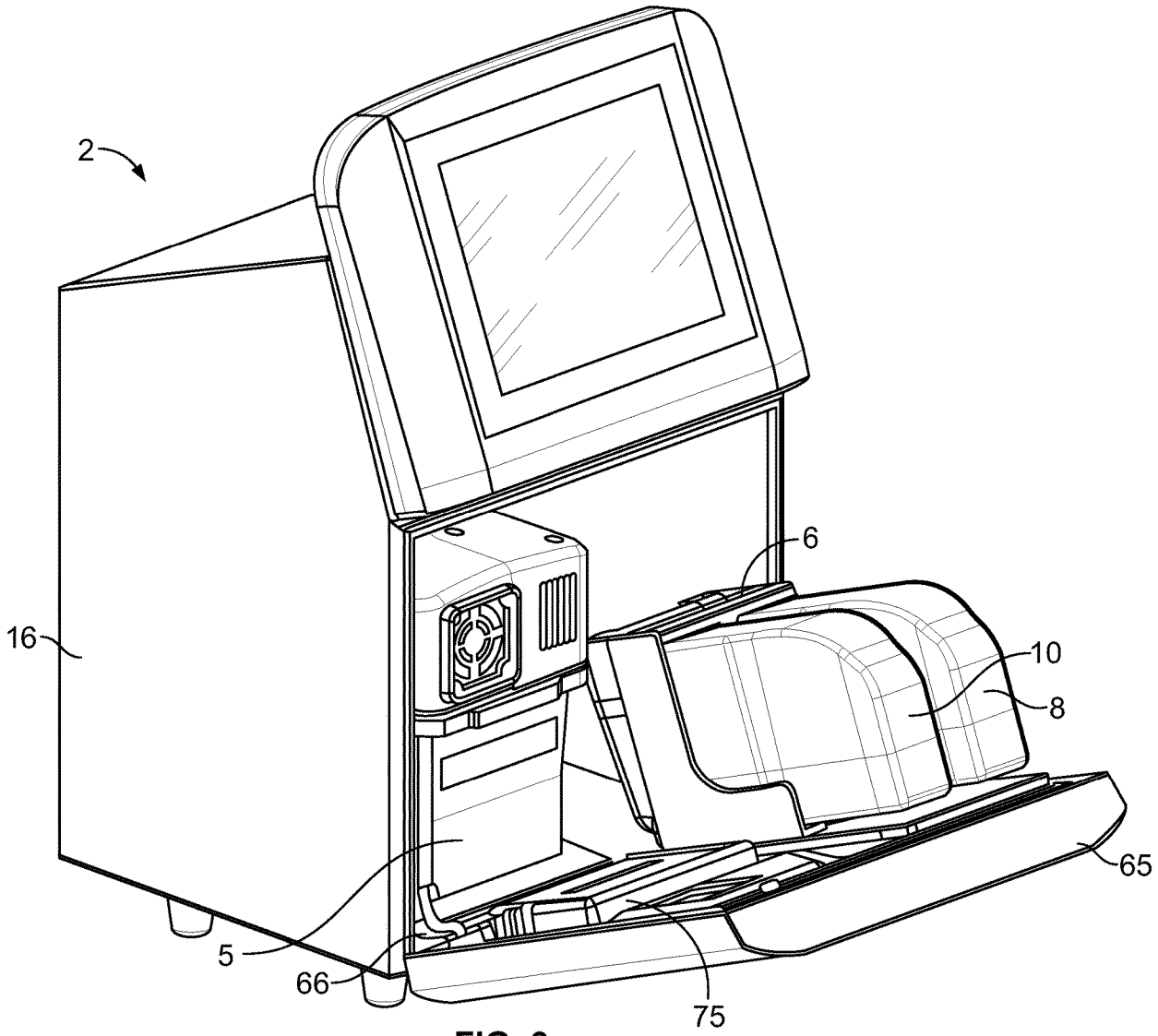
FIG. 3 is perspective illustration of part of the continuous ink jet printer of FIG. 1.

The ink jet printer 1, and particularly the ink supply system 2 is now described in further detail, with reference to FIG. 2. FIG. 2 schematically shows elements of the ink jet printer 1 of FIG. 1 in greater detail and, for clarity, the controller 4 and associated signals have been omitted.

In operation, ink is delivered under pressure from ink supply system 2 to print head 3 and back via flexible tubes which are bundled together with other fluid tubes and electrical wires (not shown) into what is referred to in the art as an "umbilical" conduit 15. The ink supply system 2 is located in a cabinet 16 which is typically stand mounted and the print head 3 is disposed outside of the cabinet 16.

The ink storage system 5 includes a mixer tank 17 for storage of a reservoir of ink 18 and a solvent tank 19 for storage of a reservoir of solvent 20. The mixer tank has a generally tapered lower portion within which the reservoir of ink 18 is disposed.

In operation, ink is drawn from the reservoir of ink 18 in mixer tank 17 by a system pump 21. The mixer tank 17 is topped up as necessary with ink and make-up solvent from replaceable ink and solvent cartridges 8, 10. Ink and solvent are transferred from the ink and solvent cartridges 8, 10 to the mixer tank 17 via the service module 6 as will be described further below.

It will be understood from the description that follows that the ink supply system 2 and the print head 3 include a number of flow control valves which are of the same general type: a dual coil solenoid-operated two-way flow control valve. The operation of each of the valves is governed by the controller 4.

Ink drawn from the mixer tank 17 is filtered first by a first (relatively coarse) filter 22 downstream of the system pump 21 and then is delivered selectively under pressure to two venturi pumps 23, 24 and a filter module 25. Filter module 25 includes a second, finer ink filter 26 and a fluid damper 27. Fluid damper 27 is of conventional configuration and removes pressure pulsations caused by the operation of the system pump 21. Ink is supplied through a feed line 28 to the print head 3 via a pressure transducer 29.

At the print head 3 the ink from the feed line 28 is supplied to a drop generator 30 via a first flow control valve 31. The drop generator 30 includes a nozzle 32 from which the pressurized ink is discharged and a piezoelectric oscillator (not shown) which creates pressure perturbations in the ink flow at a predetermined frequency and amplitude so as break up the ink stream into drops 33 of a regular size and spacing. The break up point is downstream of the nozzle 32 and generally coincides with a charge electrode 34 where a predetermined charge is applied to each drop 33. This charge determines the degree of deflection of the drop 33 as it passes a pair of deflection plates 35 between which a substantially constant electric field is maintained. Uncharged drops pass substantially undeflected to a gutter 36 from where they are recycled to the ink supply system 2 through return line 37 via a second flow control valve 38. Charged drops are projected towards a substrate (not shown) that moves past the print head 3. The position at which each drop 33 impinges on the substrate is determined by the amount of deflection of the drop and the speed of movement of the substrate.

To ensure effective operation of the drop generator 30 the temperature of the ink entering the print head 3 may be maintained at a desired level by a heater (not shown) before it passes to the first control valve 31. In instances where the printer is started up from rest it is desirable to allow ink to bleed through the nozzle 32 without being projected toward the gutter 36 or substrate. In such instances ink flows from the first control valve 31 to the nozzle 32 and then returns to the second control valve 38 via a bleed line 39, where it joins return line 37. The passage of the ink into the return line 37, whether it is the bleed flow or recycled unused ink captured by the gutter 36, is controlled by the second flow control valve 38. The returning ink is drawn back to the mixer tank 17 by venturi pump 23.

Venturi pumps 23, 24 are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurized ink flows through a pair of conduits 40, 41 and back to the reservoir 18 in the mixer tank 17. Each conduit 40, 41 is provided with a side port 42, 43 at the venturi restriction. The increase in flow velocity of the ink creates a suction pressure at the side port 42, 43 and this serves to draw returning ink and/or solvent through return line 37 and a supply line 44 respectively.

As ink flows through the system and comes into contact with air in the mixer tank 17 and at the print head 3, a portion of its solvent content tends to evaporate. The ink supply system 2 is therefore operable to supply make-up solvent as required so as to maintain the viscosity of the ink within a predefined range suitable for use.

The service module 6 includes a body 45 defining a plurality of fluid conduits (shown schematically in FIG. 2 as lines 46). The service module 6 further includes a flush pump 47 and four valves 48, 49, 50, 51 which are arranged to selectively link two or more of the plurality of fluid conduits 46 so as to form one or more fluid pathways through the body 45. The flush pump 47 and the valves 48, 49, 50, 51 are controlled by the controller 4 by sending one or more control signals via the printer connection 11. Using appropriate control signals, the service module 6 can be disposed in a plurality of different configurations to allow ink or solvent to flow through the inkjet printer 1 in a plurality of different modes, as now described. In the following, it should be assumed that each of the four valves 48, 49, 50, 51 is closed unless stated otherwise.

In operation, ink from the ink cartridge 8 and solvent from the solvent cartridge 10 can be added to the mixer tank 17 as required so as to generate printing ink of a desired viscosity which is suitable for printing. This addition of ink and/or solvent to the mixer tank 17 uses venturi pump 24.

Mixer tank 17 is provided with a level sensor (not shown) that is operable to determine a level of ink in the mixer tank 17 and output a signal indicative thereof to controller 4. Ink is consumed during printing and therefore during normal operation the level of ink in the mixer tank 17 will fall over time. When the level of ink in the mixer tank falls below a lower threshold the controller 4 is operable to control the ink supply system 2 so as to add more ink to the mixer tank 17. Using suitable control signals, ink is drawn from the mixer tank 17 by system pump 21 and delivered under pressure to venturi pump 24 to create suction pressure at the side port 43. To add ink to the mixer tank 17, valves 50, 51 in the service module 6 are opened. Ink is drawn from ink cartridge 8 along supply line 44 under suction pressure from venturi pump 24. The ink discharges into the mixer tank 17, increasing the level. When the level of ink in the mixer tank 17 reaches an upper threshold the controller 4 is operable to stop the supply of ink to mixer tank 17. To achieve this, flow to venturi pump 24 is stopped and valves 50, 51 are closed.

Following such a process of topping up the level of ink in mixer tank 17, the controller 4 sends a signal to data storage device 12 on ink cartridge 8 indicative of the quantity of ink that has been transferred from the cartridge 8 to the mixer tank 17. A quantity of ink remaining in the ink cartridge 8 may be stored on the data storage device 12 and may be updated in response to the signal from the controller 4.

As explained above, as ink flows through the system and comes into contact with air in the mixer tank 17 and that the print head 3, a portion of its solvent content tends to evaporate. Periodically, the viscosity of the ink within the mixer tank 17 (or a quantity indicative thereof) is determined using a viscometer 52 disposed in mixer tank 17.

The viscometer 52 is periodically supplied with ink under pressure from system pump 21 via filter module 25. Flow of ink into the viscometer is controlled by control valve 53. Using control valve 53, a predetermined volume of ink is supplied to a chamber within viscometer 52 and then supply of ink to the viscometer is stopped. Ink then drains out of the chamber under gravity. The rate at which the ink drains out of the chamber is dependent on the viscosity of the ink and is monitored using a plurality of electrodes disposed at different levels within the chamber. Signals from the plurality of electrodes are received by controller 4, which is operable to determine whether or not the viscosity of ink within the mixer tank 17 is within a desired operating range, defined by lower and upper threshold values.

If the viscosity is above the upper threshold value then solvent is added to the mixer tank 17 from solvent reservoir 20 in solvent tank 19 as now described. Ink is drawn from the mixer tank 17 and delivered under pressure to venturi pump 24 to create suction pressure at the side port 43. To add solvent, valves 49, 50 in the service module 6 are opened. Under suction pressure from the venturi pump 24, solvent is drawn from solvent reservoir 20 along line 62 to the service module 6 and back along supply line 44 to the mixer tank 17. The solvent discharges into the mixer tank 17, reducing the viscosity of the ink in reservoir 18.

The controller 4 may determine a quantity of solvent to add to the mixer tank 17 based on the determined viscosity of the ink. When a desired quantity of solvent has been added to the mixer tank 17, flow to the venturi pump 24 may be stopped and the valves 49, 50 are closed.

Once solvent has been added to the mixer tank 17, the viscometer 52 may be used again to determine the viscosity of ink. There may be a time delay between adding the solvent and re-checking the viscosity of the ink so as to allow the solvent to mix with ink. If upon re-checking the viscosity of the ink in mixer tank 17 the viscosity is still above the upper threshold value then more solvent may be added to the mixer tank 17 from solvent reservoir 20 in solvent tank 19. This process may be repeated until a desired viscosity of ink in mixer tank 17 is reached.

Solvent tank 19 is provided with a level sensor (not shown) that is operable to determine a level of solvent in the solvent tank 19 and output a signal indicative thereof to controller 4. Solvent is consumed during operation of the printer 1 as it is added to the mixer tank 17 to adjust the viscosity of the ink in reservoir 18. Therefore the level of solvent in the solvent reservoir 20 in solvent tank 19 falls over time.

When the level of solvent in the solvent tank 19 falls below a lower threshold, the controller 4 is operable to control the ink supply system 2 so as to add more solvent to the solvent tank 19. Using suitable control signals, valves 48, 49 in the service module 6 are opened. Solvent is drawn from solvent cartridge 10 by electric flush pump 47 in the service module 6 and is supplied through line 62 to the solvent reservoir 20. The solvent discharges into the solvent reservoir 20, increasing the level.

When the level of solvent in the solvent tank 19 reaches an upper threshold the controller 4 is operable to stop the supply of solvent to solvent tank 19. To achieve this, flow to flush pump 47 is stopped and valves 48, 49 are closed.

Following such a process of topping up the level of solvent in solvent tank 19, the controller 4 sends a signal to data storage device 13 on solvent cartridge 10 indicative of the quantity of solvent that has been transferred from the cartridge 10 to the solvent tank 19. A quantity of solvent remaining in the solvent cartridge 10 may be stored on the data storage device 13 and may be updated in response to the signal from the controller 4.

Make-up solvent, provided from the solvent cartridge 10, is also used to flush the print head 3 at appropriate times to keep it clear of blockages, as now described. Ink is drawn from the mixer tank 17 and delivered under pressure to venturi pump 23 to create a suction pressure at the side port 42. Solvent is drawn from solvent cartridge 10 by electric flush pump 47 in the service module 6 and is supplied through a flush line 54 to the print head 3 via filter 55. Flow of solvent from the service module 6 to the print head 3 is controlled by first control valve 31.

A pressure relief valve 56 is connected across the inlet and outlet of the flush pump 47 and acts to relieve excess pressure to the suction side of the flush pump 56. For example, pressure relieve valve 56 may be arranged to maintain a desired pressure downstream of the flush pump 47, for example 2.5 bar.

The solvent flows through the first control valve 31 to the nozzle 32. After passing through the nozzle 32 and into the gutter 36 the solvent (along with dissolved ink from the print head 3) is drawn into the return 32 under suction pressure from the venturi pump 23. The solvent and ink discharge into the mixer tank 17.

As explained above, flow of ink and solvent into mixer tank 17 is achieved using venturi pump 24, which requires a minimum quantity of fluid in mixer tank 17. If there is insufficient fluid in the mixer tank 17 for operation of the venturi pump 24 (e.g. before a first use of the ink supply system 2), the flush pump 47 in service module 6 can be used to prime the mixer tank 17 by adding fluid to it.

To prime the mixer tank 17, an ink cartridge is engaged with the solvent cartridge connection 9. To add ink to the mixer tank 17, valves 48, 50 in the service module 6 are opened. Ink is drawn from an ink cartridge (in the solvent cartridge connection 9) by electric flush pump 47 in the service module 6 and is supplied through supply line 44 to the mixer tank 17 via side port 42. Once a sufficient quantity of ink has been added to the mixer tank 17, flush pump 47 is stopped and valves 48, 50 are closed.

In use, the atmosphere in the mixer tank 17 and the solvent tank 19 can become saturated with solvent. A condenser unit 57 is provided in an upper portion of the solvent tank 19. Condenser unit 57 may, for example, include a Peltier-type condenser.

A ventilation tube 58 is provided between the mixer tank 17 and the solvent tank 19 to allow air to flow therebetween. The ventilation tube 58 is arranged such that it links a space above the reservoir of ink 18 to a space above the reservoir of solvent 20. Solvent-laden vapor from the mixer tank 17 enters the solvent tank 19 via ventilation tube 58. The air from the mixer tank 17 is warmer than the air in the solvent tank (due to the action of the system pump 21), and therefore it rises to the top of the solvent tank via ventilation tube 58, where it enters the condenser unit 57.

Solvent condenses as the air contacts an active element within the condenser unit 57 and is cooled. The condensate (solvent) drains into the solvent reservoir 20. The dried air (from which the solvent has been removed) enters the common port of a three-way control valve 59. The flow of air through the system can be controlled using control valve 59, as now described.

The dried air from the condenser unit 57 may flow through exit line 60, via which it is vented to the air space inside the printer cabinet 16. This air flow path may be a default configuration for control valve 59.

Alternatively, the dried air from the condenser unit 57 may flow through line 61 which passes through the umbilical 15 to the print head 3. Line 61 terminates in the print head 3 at return line 37, near the gutter 36. Vacuum pressure draws the vented air along the return line 37 towards the second control valve 38 (along with any ink entering the gutter 36). Normal operation of venturi pump 23 draws the unused ink drops and vented air along the return line 37, through the umbilical 15 and back to side port 42. The unused ink and vented air are both discharged into the mixer tank 17.

When control valve 59 is used to direct the dried air from the condenser unit 57 through line 61, a 'closed' hydraulic loop is created. Any solvent vapor which is not recovered by the condenser unit 57 passes back to the mixer tank 17 via lines 61, 32 and loss of solvent from the inkjet printer 1 is therefore minimized. The system recirculates the same air continuously, which prevents (or at least minimizes) the influx of ambient air, which would otherwise enter via the gutter 36 (e.g. if the control valve 59 is venting the dried air from the condenser unit 57 to the air space inside the printer cabinet 16 via exit line 60). This preclusion of ambient air entering the system helps to prevent oxygen ingestion via the gutter 36, which promotes improved ink performance over the long term by reducing the probability of ink oxidation.

As will be described in more detail below, in some embodiments, the service module 6 further includes a gas sensor, which may be operable to determine the presence or level of a gas (such as solvent vapor) within the cabinet 16. Gas sensors can become "poisoned" over time and therefore generally have a finite service lifetime, requiring replacement thereafter.

The service module 6 provides an interface between the inkjet printer 1 and each of ink and solvent cartridges 8, 10, allowing fluid to flow from each of the cartridges 8, 10 to the inkjet printer and providing an electrical link between the inkjet printer 1 and each of the cartridges 8, 10. Since the printer connection 11 provides for releasable engagement with an inkjet printer the service module 6 can be easily removed from the inkjet printer 1 for servicing or replacement. In general, such servicing or replacement will be performed at a different rate to that of replacement of the fluid cartridges 8, 10, or the rate of replacement of other replaceable components of the printer 1. This is advantageous because during operation of the inkjet printer 1, one or more of the plurality of conduits 46, valves 48, 49, 50, 51 and flush pump 47 may become blocked or damaged, or the gas sensor may reach the end of its useful life.

Referring to FIGS. 3 to 8, the physical arrangement of the ink supply system 2 and associated components are described in more detail. The ink supply system 2 includes cabinet or housing 16 having a door 65. The cabinet 16 contains ink supply system components such as, for example, the ink storage system 5, the service module 6 and the ink and solvent cartridges 8, 10.

The ink supply system cabinet 16 includes three generally vertical side walls arranged to provide three adjacent sides of the cabinet 16, an aperture to a fourth side, a top and a base. The door 65 is pivotally connected to the cabinet 16 such that the door can be opened by pivoting about a pivot 66 (shown open in FIG. 3). The pivot 66 is provided along an edge the base of the cabinet 16 which is adjacent to the aperture. The three side walls, the door 65, the top and the base are arranged to enclose a volume of space in which the components of the ink supply system 2 are housed. When the cabinet 16 is in a normal upright orientation, with the door 65 in the closed position, such as during printing operations, the base of the cabinet 16 is at the bottom of the cabinet 16 (i.e. it is the lowest part of the cabinet 16). The pivot 66 is thus provided at the lowest part of the door 65. The door 65 can be opened so as to access the internal components of the cabinet 16, such as, for example, the ink storage system 5, the service module 6 and the ink and solvent cartridges 8, 10.

Figure 4:
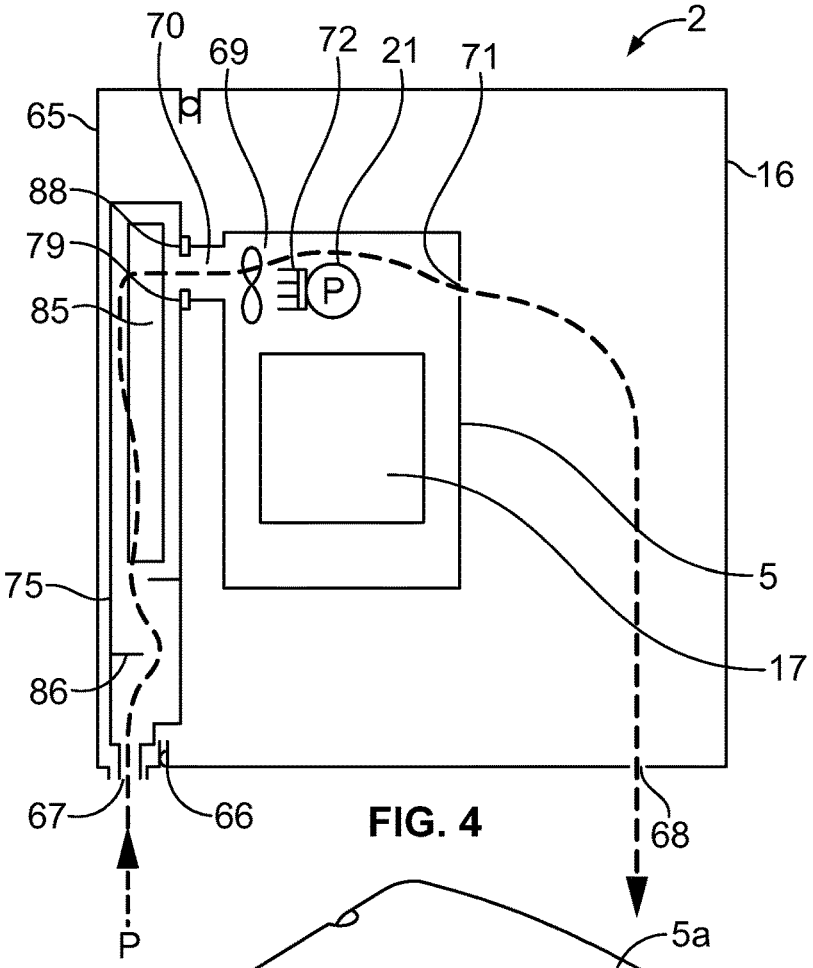
FIG. 4 is a schematic illustration of the part of the continuous ink jet printer shown in FIG. 3.

As best seen in FIG. 4, when in the closed position, the door 65 forms a seal with the cabinet 16, such that vapors and liquid do not escape from between the cabinet 16 and the door 65. An air inlet 67 is provided at the bottom of the door 65 and is arranged such that when the door is in the closed position the air inlet 67 is oriented facing vertically downwards. The air inlet 67 allows air to flow into the cabinet 16 via the door 65 (even when the door 65 is closed). The cabinet 16 is also provided with an air outlet 68 which may be provided within the base of the cabinet 16 and allows air to flow out of the cabinet 16. The air flow through the cabinet 16 is described in more detail below.

The ink storage system 5 contains the system pump 21, the mixer tank 17, filter module 25, and other ink storage system components discussed in more detail above, and shown schematically in FIG. 4. The ink storage system 5 further includes a fan 69, an air inlet 70 and an air outlet 71. The system pump 21 is provided with a heat sink 72. The operation of the fan 69, air inlet 70, air outlet 71 and heat sink 72 are described in more detail below.

Figure 5A:
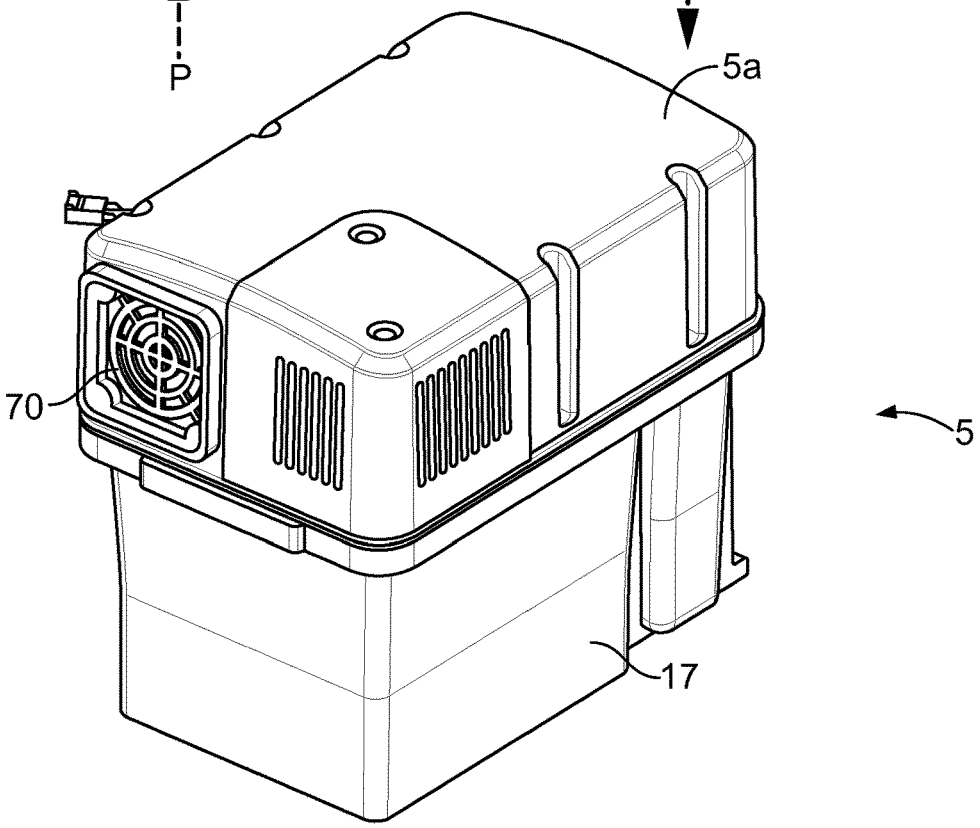
FIGS. 5A-5C are perspective illustrations of a part of the continuous ink jet printer of FIG. 1.
Figure 5C:
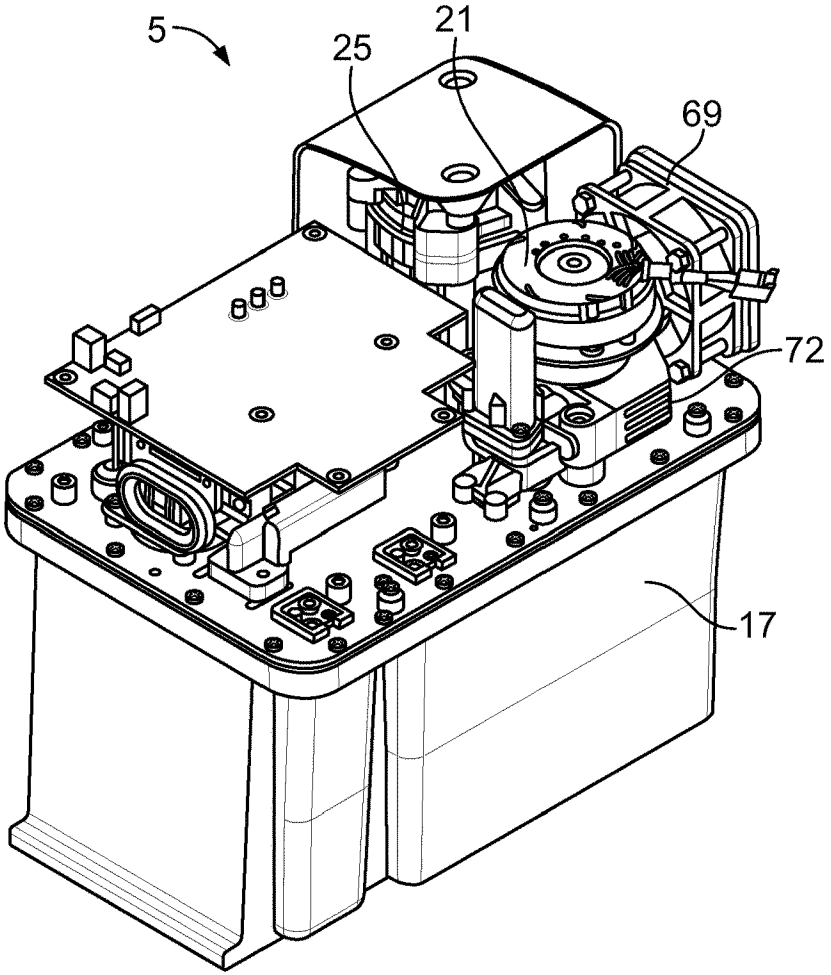
Figure 5B:
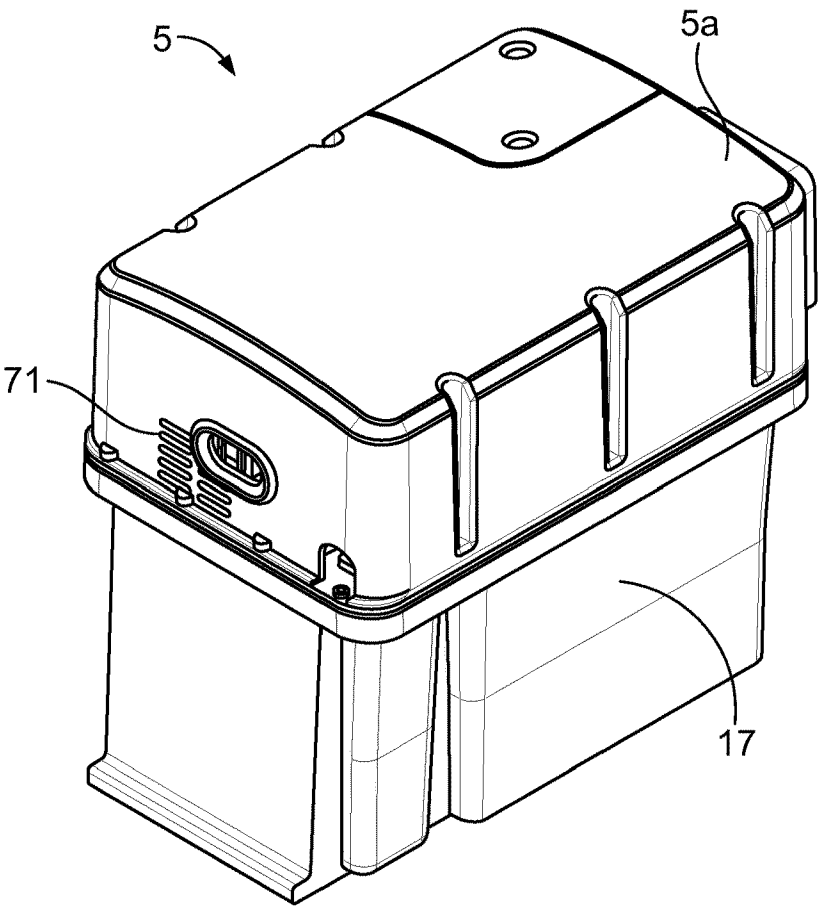

FIG. 5A shows the external appearance of the ink storage system 5, showing air inlet 70, while FIG. 5B shows the external appearance of the ink storage system 5, showing air outlet 71. FIG. 5C shows the ink storage system 5 with a top cover 5a removed, showing the fan 69, system pump 21, heat sink 72 and filter module 25.

The door 65 includes a body portion 73, as shown in FIG. 6A, which forms part of the exterior of the cabinet 16. The body portion 73 is provided with a molded insert 74, as shown in FIG. 6B which is received therein. The molded insert 74 is configured to receive a filter unit 75, which is shown in FIG. 6C. The filter unit 75 can be removed from the door 65 when the door 65 is in the open position.

Figure 7A:
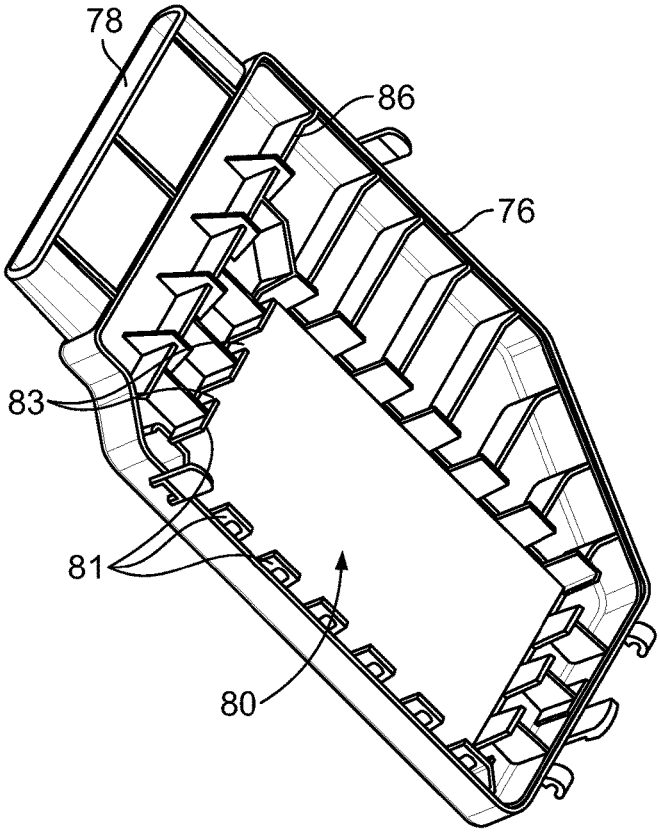
FIGS. 7A-7C are perspective illustrations of parts of the continuous ink jet printer of FIG. 1.
Figure 7B:
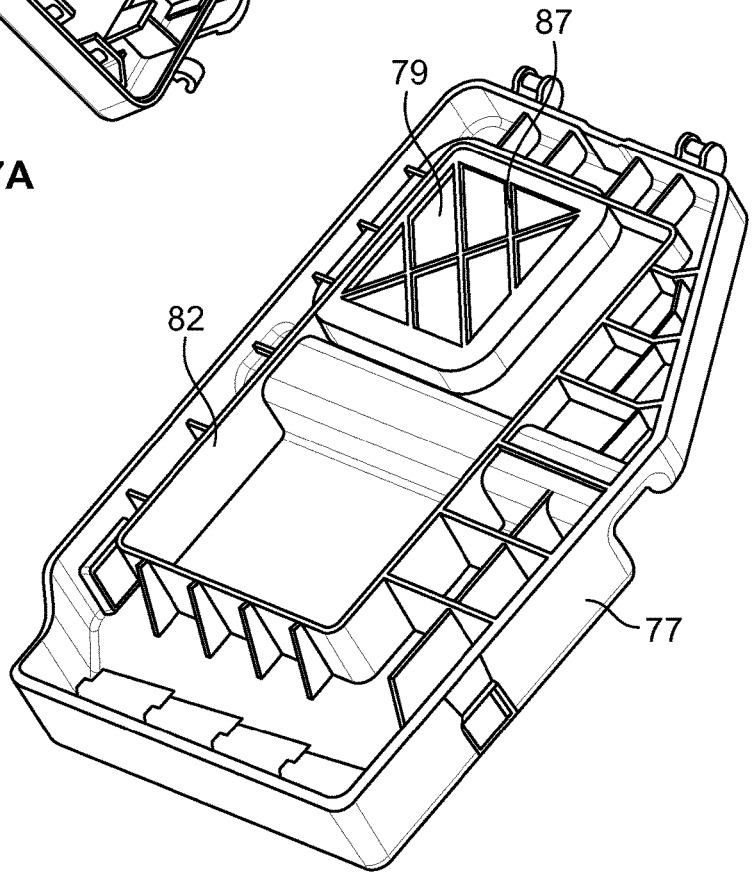
Figure 7C:
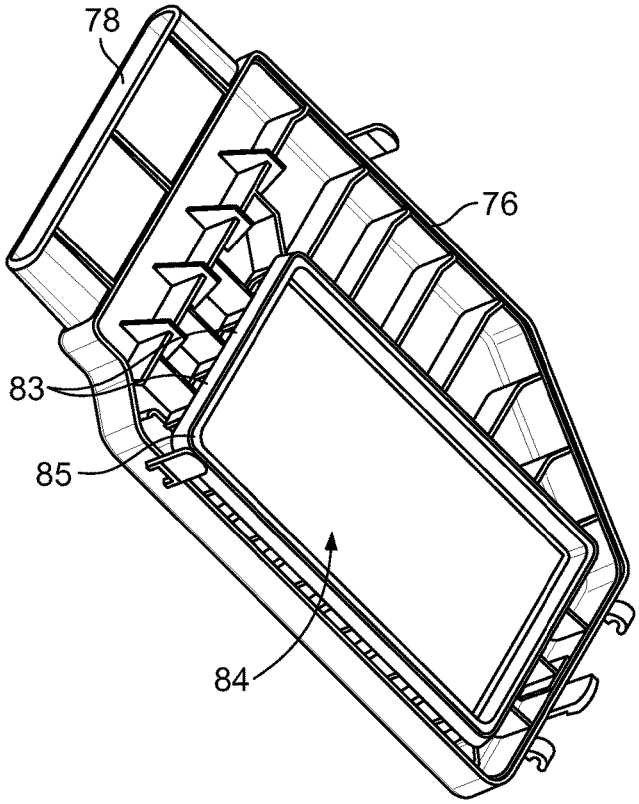

The filter unit 75 is shown in more detail in FIGS. 7A to 7C. The filter unit 75 includes a body having a first housing portion 76 (FIG. 7A) and a second housing portion 77 (FIG. 7B) which may be, for example, plastic moldings. The first housing portion 76 and the second housing portion 77 may, for example, be assembled to form the filter unit 75 by snap fitting together. The first and second housing portions 76, 77 may be hinged together so as to allow the filter unit 75 to be opened.

The filter unit further includes a filter unit air inlet 78 and a filter unit air outlet 79. The filter unit 75 further includes a recess 80 to receive an air filter. The recess is defined by corresponding wall portions provided by the first and second housing portions 76, 77. A first wall portion 81 is provided by the first housing portion 76, and a second wall portion 82 is provided by the second housing portion 77. The first wall portion 81 protrudes from an internal surface of the first housing portion 76 to define a perimeter of the recess 80. A plurality of apertures 83 are provided within the first wall portion to allow air to flow into the recess 80 from the filter unit air inlet 78. The second wall portion 82 is continuous (i.e. it has no apertures), and also defines the perimeter of the recess 80. The second wall portion 82 protrudes from an internal surface of the second housing portion 77.

In use an air filter 84 is provided within the recess 80. The filter 84 is shown located within the recess in FIG. 7C. The filter includes a sealing portion 85 around its perimeter. The sealing portion 85 is arranged to engage with the second wall portion 82 when the first and second housing portions 76, 77 are assembled so as to form a seal. This seal ensures that there is no direct path for air to flow from the inlet 78 to the outlet 79 without passing through the filter 84.

The sealing portion 85 may, for example, include polyurethane. The air filter 84 may include appropriate filter media such as filter paper. Appropriate filter paper may have a weight of about 130 g/m$^2$. For example a weight in the range of 125 to 135 g/m$^2$. The filter paper may have a thickness of greater than or equal to 0.43 mm, and/or air permeability of greater than or equal to 240 liters/minute. The paper may have a maximum pore size of less than or equal to 71 μm, and/or a minimum pore size of greater than or equal to 61 μm. The paper may have a bursting strength of around 280 kPa, and/or an air flow resistance of less than or equal to 1.8 mbar and/or a corrugation depth of between 0.1 and 0.25 mm.

The filter unit 75 further includes an inlet baffle 86. The inlet baffle 86 protrudes from the internal surface of the first housing portion 76. The filter unit 75 further includes an outlet grille 87 and an outlet seal 88 (best seen in FIG. 8).

In general terms, the filter unit 75 provides an enclosure which contains the filter 84, and allows air to be directed along a predetermined flow path, as described in more detail below.

The use of solvents within the printing apparatus may result in solvent vapor leaking from the fluid pathways and components within the cabinet 16. Moreover, the venting of dried air within the cabinet 16 is routine (as described above in more detail). This may result in elevated solvent vapor levels within the cabinet 16 if the dried air is not entirely free from solvent vapor. It is desirable, therefore, to provide air circulation within the cabinet 16 to carry away any solvent vapor before it can reach harmful or dangerous levels. Such purging air circulation is common place within continuous inkjet printers. However, it has been realized that by arranging various components of the printer 1 in a certain way, the purging airflow can be used to particularly beneficial effect. That is, the airflow through the cabinet 16 can be caused to flow through a predetermined flow path P in which it performs several useful functions, and also in which components which may be required to be accessed for preventative maintenance purposes are readily accessible. Further, the purging air flow can be used to improve thermal management. Indeed, various components within the ink delivery system 2, and in particular the ink storage system 5, such as pumps (e.g. the system pump 21) and motors generate heat the can increase the temperature of the ink within the printer 1. As the ink temperature increases, the tendency for solvents to volatilize also increases. Further, increased temperature also changes the viscosity of the ink, which must be controlled to within desired ranges to achieve optimal printing performance.

Figure 8:
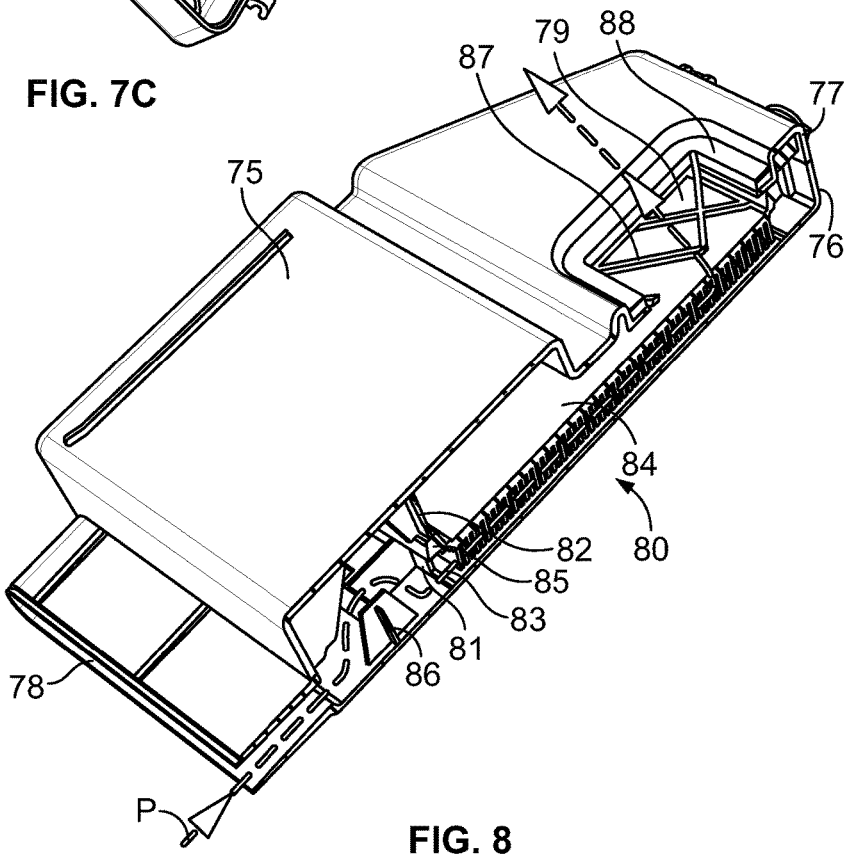
FIG. 8 is a perspective cross-sectional illustration of part of the continuous ink jet printer of FIG. 1.

The predetermined air flow path P through the cabinet 16 is now described in detail with reference to FIGS. 3 to 8. The airflow is caused by the fan 69, which is located with the ink storage system 5. The fan 69 causes a negative pressure to be generated upstream of the fan 69, between the fan 69 and the air inlet 70. This generated negative pressure causes air to be drawn through the filter unit 75, via the door inlet 67, as shown in detail in FIGS. 4 and 8. Air is initially drawn into the door inlet 67, and then (as shown in FIG. 8) into the filter unit air inlet 78. Once within the filter unit 75 air passes around the inlet baffle 86 and into the filter recess 80 through the apertures 83. From the cavity 80 air flows through the air filter 84 and out of the filter unit outlet 79.

The inlet baffle 86 obstructs the direct path to the filter cavity 80 from the filter unit inlet 78 forming an inlet labyrinth. This ensures that when the printer 1 is operated in wet environments, such as food production environments which are routinely washed-down, water is unlikely to splash directly onto the filter 85 within the filter cavity 80. Further, the orientation of the filter unit 75 when the door 65 is closed is such that the filter unit inlet 78 is provided on a side of the filter unit 75 which is directed substantially downwards, such that water ingress is minimized. The filter unit inlet 78 mates with the air inlet 67 provided within the door 65.

The outlet seal 88 engages with the air inlet 70 of the ink storage system 5 forming an air-tight seal. This seal results in a majority of air being drawn into the ink storage system inlet 70 via the air filter unit 75 (i.e. along the predetermined air flow path P), and a minimal amount of air being drawn into the ink storage system inlet 70 from the interior of the cabinet 16. The filter unit air outlet 79 is disposed on a side of the filter unit which faces the ink storage system 5. The filter unit air outlet 79 is thus a provided on a side of the filter unit 75 which is substantially perpendicular to the side on which the filter unit air inlet 78 is provided (the filter unit air inlet 78 being directed substantially downwards).

Once the air passes the fan 69, it is driven along a path which passes over the system pump 21, which is located adjacent to the fan 69. The proximity of the fan 69 to the system pump 21 results in a significant cooling effect being provided to the system pump 21. Additionally, the close proximity of the fan 69 to the system pump 21 may result in turbulent air from the fan being directed over the system pump 21. This turbulence increases the cooling effect of the air flow on the system pump 21. Such an effect may also allow the fan 69 to cool the system pump 21 in the event that the air flow into the cabinet 16 via the filter unit 75 becomes obstructed. That is, re-circulation of air within the cabinet, and in particular the creation of turbulent air-flow around the system pump 21 may cause some heat to be transferred away from the system pump 21 (albeit to a lesser extent than when air is drawn into the cabinet 16).

Moreover, the system pump 21 is located close to the ink system air inlet 70. Such proximity between the system pump 21 and the air inlet 70 results in the air which reaches the system pump 21 being as cool as possible. That is, the temperature of the air which flows over the system pump 21 has not been raised by mixing with warmer air within the ink storage system 5, or by passing over other system components which may raise the temperature before it has reached the system pump 21.

It will be appreciated that the system pump 21 may be required to operate continuously for extended periods of time. The temperature of the system pump 21 may thus become elevated as a result of such continuous operation.

The flow or air directly over the system pump 21 causes heat to be carried away from the pump 21, allowing a safe operating temperature to be maintained even when the pump 21 is required to operate for extended periods. This cooling effect also prevents the ink from exceeding the desired temperature operating range, especially when the ambient temperature is high. The pump 21 thus allows heat from the ink itself to be dissipated. This provides an additional advantage in that heat from the ink is dissipated without the need for a dedicated ink cooling apparatus. Moreover, the provision of active cooling of the system pump 21 may allow the printer 1 to be operated in a wider range of thermal conditions. The range of ambient temperatures in which the printer 1 can operate with such cooling may, for example, be from 0 to 50° C.

The system pump 21 is additionally provided with the heat sink 72. The heat sink 72 may, for example, be formed from a material having a high thermal conductivity (e.g. a metal, such as, for example, aluminium). The heat sink 72 is in thermal communication with the pump 21 such that heat generated within the pump is able to flow to the heat sink 72. The heat sink 72 is shaped to have a large surface area, for example by being provided with fins, so as to maximize the heat transferred away from the system pump 21. The arrangement of the heat sink 72 and directed air flow further enhances the ability of the printer 1 to operate across a wide range of ambient temperatures and conditions.

Once the air passes the system pump 21 the air flow path exits the ink storage system 5 via the outlet 71, which takes the form of a slotted grille in the housing of the ink storage system 5.

In some embodiments, in addition to the air flow path passing the system pump 21 (and heat sink 72), the air flow path may be used to cool other ink storage system components. For example, the air flow path may be directed over electronic components housed within the ink storage system 5 so as to cool those electronic components.

Further, an additional heat sink may be associated with the condenser unit 57 (which is best seen in FIG. 2). That is, a condenser heat sink may be in thermal communication with the condenser unit 57. The air flow caused by the fan 69 may be caused to flow over the condenser heat sink, providing cooling to the condenser unit 57. This provides an additional advantage in that thermal energy extracted from solvent-laden vapor during the condensation process is dissipated as heat from the condenser unit 57 without the need for a dedicated cooling apparatus, such as an additional fan.

Finally, the air exits the cabinet 16 via the outlet 71 in the base of the cabinet 16. The sealed nature of the cabinet 16 (including seal with door 65) results in the outlet 71 being the only available exit for air.

The filter unit 75 may be removed from the ink supply system 2, and replaced as necessary. It will be appreciated that such a components may be required to be replaced at regular service intervals so as to ensure that the filter 84 remains in good condition and is not blocked. The filter 84 may be replaced at regular intervals such as for example after about 2000 hours of printer operation. Such regular preventative maintenance may be carried out so as to ensure adequate air circulation within the cabinet 16, and in particular to ensure adequate cooling performance of the system pump 21 and ink for continued operation. The provision of a separate and removable filter unit allows for convenient maintenance by untrained personnel which minimizes the risk that any critical system components are interfered with during maintenance. Further, a removed air filter unit 75 may be replaced with new air filter unit, or otherwise re-conditioned by replacement of the filter 84. The first and second housing portions 76, 77 may be hinged open so as to access and replace the filter 84. Embodiments of the invention thus provide a printing apparatus which can be maintained conveniently with minimal risk of error or unnecessary complication.

The provision of a filter unit 75 which may be removed and replaced as necessary allows any accumulation of unwanted, and possibly unhygienic, matter to be prevented, or at least reduced. For example, the filter unit 75 may be removed from the cabinet 16 and replaced with a clean filter unit during a cleaning process. Alternatively, the filter unit may be arranged so that the filter housing portions 76 and 77 can be opened by a user and just the filter 84 replaced. Additionally, a filter unit may be removed from the cabinet 16, the filter unit 75 opened, and the air inlet labyrinth (including inlet baffle 86) cleaned at any convenient interval (e.g. daily, or between preparation of two different foods on the production line).

This may be particularly appropriate where the printer 1 is used in hygienic environments such as food production environments. It will be appreciated that "a hygienic environment" may include any environment which it is desired to keep clean. Such environments include food preparation environments, medical environments (e.g. for pharmaceutical or medical product manufacture) or the like.

It will be appreciated that the air flow path described above is the primary air flow path, and that there may be some deviations from this path. For example, there may be some leakage of air from the cabinet 16 from access ports (e.g. such as access ports provided for conduit 15). Further, seals forms between the cabinet 16 and the door 65, and the filter unit outlet 79 and ink storage system inlet 70 may not be perfect seals. Some air may leak through these seals. Moreover, rather than flowing directly from the ink system air outlet 71 to the air outlet 68 the air may circulate within the cabinet 16 before eventually exiting through the air outlet 68. However, a majority of air flow driven by the fan 69 will follow an air flow path substantially as described above.

In the above described embodiment the airflow is driven by the fan 69 which is located within the ink storage system 5. It will be appreciated, however, that the airflow may instead be driven by alternative air circulation devices, such as, for example a vacuum pump applied to a vacuum port (which may be provided at the outlet 68). Alternatively, air may be blown into an air inlet by an externally provided air supply. In a further alternative an air circulation device may be located at different locations within or about the cabinet 16. In some embodiments an air circulation device is located between the filter unit 75 and the ink storage system 5.

Further, in some embodiments the air circulation device includes a plurality of air circulation devices. For example, in an embodiment a primary air circulation device is provided which causes air to flow through the cabinet 16, while a secondary air circulation device is provided adjacent to the ink pump within the cabinet so as to cause air to flow past the ink pump and thus to cause heat to be transferred away from the ink pump. In such an embodiment the primary air circulation device may be provided externally of the cabinet 16.

It will be appreciated that embodiments of the invention may deviate from that which is described above. For example, the provision of first and second housing portions 76, 77 of the filter unit 75, having various protrusions molded thereon (e.g. baffle 86, first and second walls 81, 82) is simply one implementation. Such features may be provided by separate component parts, or by the same component parts in alternative arrangements. Further an inlet labyrinth (described above as including the inlet baffle 86) may be formed in any convenient way so as to obstruct the direct path between the filter unit air inlet 78 and the filter cavity 80.

Thus, the present system provides an ink jet printer with an improved air circulation and cooling system. The system helps to maintain the desired temperature of the ink within the system to reduce solvent loss and maintain the ink viscosity within a desired range.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. An apparatus for use in continuous inkjet printing, comprising:

a cabinet;

an ink system located in the cabinet, the ink system comprising an ink pump, an ink system air inlet, and an ink system air outlet;

an air circulation device arranged to cause air to flow within the cabinet; and an air filter unit arranged to receive an air filter, the air filter unit comprising a filter unit air inlet, and a filter unit air outlet;

wherein, in use, the filter unit air outlet is arranged adjacent, the ink system air inlet; and wherein the air circulation device is arranged to cause air to flow along a predetermined air flow path through the filter unit air inlet, the air filter, the filler unit air outlet, the ink system air inlet, past the ink pump, and through the ink system air outlet.

2. The apparatus according to claim 1, wherein air flow along the predetermined air flow path cools the ink pump and thereby cools ink passing through the ink pump.

3. The apparatus according to claim 1, wherein the filter unit air inlet is arranged to mate with an air inlet of the cabinet.

4. The apparatus according to claim 1, wherein the filter unit air outlet is arranged to mate with the ink system air inlet.

5. The apparatus according to claim 1, wherein the air circulation device is provided in the air flow path intermediate the ink system air inlet and the ink system air outlet.

6. The apparatus according to claim 1, wherein the air circulation device is provided in the air flow path intermediate the ink system air inlet and the ink pump.

7. The apparatus according to claim 1, wherein the ink system further comprises an ink pump heat sink in thermal communication with the ink pump, and wherein the air circulation device is arranged to cause air to flow past the ink pump heat sink.

8. The apparatus according to claim 1, wherein the ink system further comprises a condenser for condensing solvent vapor, and a condenser heat sink in thermal communication with the condenser, and wherein the air circulation device is arranged to cause air to flow past the condenser heat sink.

9. The apparatus according to claim 1, wherein the cabinet comprises a base, and wherein an air outlet is provided at the base of the cabinet, the air circulation device causing air to flow along the predetermined path and through the air outlet.

10. The apparatus according to claim 1, wherein the cabinet comprises a door, and wherein the air filter unit is received within the door.

11. The apparatus according to a claim 10, wherein the door comprises an air inlet and wherein the filter unit air inlet is arranged to mate with the air inlet when the air filter unit is received within the door.

12. The apparatus according to claim 10, wherein the door is moveable between an open position and a closed position and wherein when in the closed position the filter unit air outlet is arranged adjacent the ink system air inlet.

13. The apparatus according to claim 1, wherein the air filter unit comprises an inlet labyrinth arranged to obstruct a direct path between the filter unit air inlet and the air filter.

14. A filter unit for a continuous inkjet printer comprising:

a body;

a filter unit air inlet defined by the body and arranged to mate with an air inlet of an ink jet printer cabinet;

a recess for receiving an air filter defined by the body;

an inlet labyrinth disposed within the body between the filter unit air inlet and the air filter and arranged to obstruct a direct path between the filter unit air inlet and the air filter, and a filter unit air outlet defined by the body and arranged to mate with an air inlet of an ink system located in an ink jet printer cabinet.

15. The filter unit according to claim 14, wherein the air inlet is defined in a first side of the body and the outlet in a second side of the body, the first and second sides being generally perpendicular.

16. The filter unit according to claim 14, wherein the body is formed of two components which are hinged together.

17. The filter unit according to claim 16, wherein the air filter is removable from the recess by opening the two components.

18. The filter unit according to any one of claims 14, wherein the filter unit air outlet is configured to form a seal with an air inlet of an ink system located in an ink jet printer cabinet.

19. The filter unit according to claim 18, wherein the filter unit comprises a seal member configured to engage with an outer surface of an air inlet of an ink system to form the seal.

20. An apparatus for use in continuous inkjet printing, comprising:

a cabinet;

an ink system located in the cabinet, the ink system comprising an ink pump; an air filter unit arranged to receive an air filter; and an air circulation device arranged adjacent to the ink pump and arranged to cause air to flow through the air filter and past the ink pump along a predetermined air flow path;

wherein air flow along the predetermined air flow path cools the ink pump and thereby cools ink passing through the ink pump.

* * * * *